United States Patent [19]

Hemphill

[11] 4,121,947

[45] Oct. 24, 1978

[54] METHOD OF CLEANING A PHOTORECEPTOR

[75] Inventor: Kent W. Hemphill, Rochester, N.Y.

[73] Assignee: Xerox Corporation, Stamford, Conn.

[21] Appl. No.: 812,871

[22] Filed: Jul. 5, 1977

[51] Int. Cl.[2] ..... B08B 1/04; B08B 5/04; B08B 6/00

[52] U.S. Cl. ..... 134/1; 15/301; 134/6; 134/9; 134/16; 134/21; 355/15

[58] Field of Search ..... 134/1, 15, 16, 21, 6, 134/9; 355/15; 118/652; 15/1.5, 301

[56] References Cited

U.S. PATENT DOCUMENTS

| | | | |
|---|---|---|---|
| 2,752,271 | 6/1956 | Walkup et al. | 134/1 |
| 3,668,008 | 6/1972 | Severynse | 134/1 |
| 3,743,540 | 7/1973 | Hudson | 134/1 |
| 3,838,921 | 10/1974 | Sargis | 355/15 |
| 4,007,982 | 2/1977 | Stange | 134/1 X |

OTHER PUBLICATIONS

Fisler, Defensive Publication of SN 18,884, Filed 3-1-2-70, Published in 983 O.G.401 on 12-14-71.

*Primary Examiner*—Marc L. Caroff
*Attorney, Agent, or Firm*—J. J. Ralabate; C. A. Green; H. Fleischer

[57] ABSTRACT

Charged residual toner is removed from a photoreceptor by simultaneously (1) exposing the photoconductive layer of the photoreceptor to light, (2) charging the photoconductive layer to the same polarity as that of the toner, (3) vibrating the photoreceptor to dislodge the toner by entraining the photoreceptor about a roller while rotating the roller about an eccentric axis, and (4) subjecting the toner to a force (e.g. vacuum or gravity) which draws the toner away from the photoreceptor.

5 Claims, 4 Drawing Figures

METHOD OF CLEANING A PHOTORECEPTOR

BACKGROUND OF THE INVENTION

The present invention relates to an improved method of cleaning charged residual toner from the photoconductive surface of a photoreceptor.

In conventional xerography, a xerographic member comprising a layer of photoconductive insulating material affixed to a conductive backing is used to support electrostatic latent images. In the xerographic process, the photoconductive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner." Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., a sheet of paper), and the image is affixed thereto to form a permanent record of the original document.

Residual toner remaining on a photoreceptor after transfer is conventionally removed by an abrasive cleaner such as a blade, brush, or web. Physical contact between the cleaner and the photoreceptor results in wear on both the cleaner and the photoreceptor. To overcome the problem of wear, a method is needed by which the photoreceptor can be cleaned without physically contacting the same.

SUMMARY OF THE INVENTION

The present invention is directed to an improved method of cleaning a photoreceptor to remove charged residual toner therefrom. The method preferably includes the simultaneous steps of exposing the photoconductive layer of the photoreceptor to light, charging the photoconductive layer to the same polarity as that of the residual toner, vibrating the photoreceptor, and drawing the toner away from the photoreceptor by vacuum.

DESCRIPTION OF THE INVENTION

Figure 1:
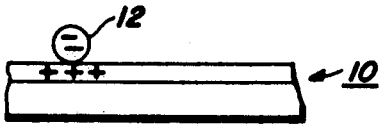
FIG. 1 shows a conventional pre-clean state of a photoreceptor.

The following discussion relates to the type of electrostatic reproduction machine in which the present invention may be used. As in all electrostatic reproduction machines of this type, a light image of an original is projected onto the photoconductive surface of a charged photoreceptor to form an electrostatic latent image thereon. Thereafter, the latent image is developed with an oppositely charged developing material comprising carrier beads and toner particles triboelectrically adhering thereto to form a xerographic powder image corresponding to the latent image on the photoconductive surface. The powder image is then electrostatically transferred to a transfer member such as a sheet of paper to which it may be fixed by a fusing device whereby the toner image is caused to adhere to the transfer member.

Discussing this type of machine more specifically, an original to be copied is placed upon a transport support platen fixedly arranged in an illumination assembly. While upon the platen, the illumination assembly flashes light rays upon the original, thereby producing image rays corresponding to the informational areas on the original. The image rays are projected by means of an optical system to an exposure station for exposing the surface of a moving photoreceptor which may be in any suitable form such as a drum or a flexible belt. Prior to reaching the exposure station, that portion of the photoreceptor being exposed would have been uniformly positively charged by a corona generating device. In the example described herein, it will be assumed that the photoreceptor has been positively charged although the present invention is also applicable to a xerographic member which has been negatively charged.

The exposure of the photoreceptor to the light image discharges the surface in the areas struck by light whereby an electrostatic latent image remains on the photoreceptor in image configuration corresponding to the light image projected from the original on the support platen. As the photoreceptor continues its movement, the latent image passes through a developing station where a developing apparatus is positioned. The developing apparatus causes negatively charged toner to be deposited on the latent image to produce an electrostatic developed image on the photoconductive surface of the photoreceptor.

The developed image is transported by the photoreceptor to a transfer station where a sheet of paper is moved into contact with the developed image at a speed in synchronism with the photoreceptor in order to effect transfer of the developed image. The back side of the sheet of paper is positively charged by a corona generating device or electrically biased transfer roll as the paper is moved into contact with the developed image so that the developed image on the photoreceptor may be electrostatically attracted to the sheet of paper as the latter is brought into contact therewith.

As a sheet of paper emerges from the transfer station, the sheet is removed from the photoreceptor by a stripping mechanism and is transported into a fuser assembly where the developed image on the sheet is permanently affixed thereto. After fusing, the finished copy is discharged at a suitable point for collection. The charged toner remaining as residue on the photoreceptor is carried by the photoreceptor to a cleaning apparatus where the toner is removed before the photoreceptor is charged once again. Everything that has been discussed up to this point is conventional.

As stated above, however, conventional cleaning methods use abrasive elements to contact the photoreceptor resulting in wear of both the cleaning element and the photoreceptor. It is the wear problem to which the present invention is directed.

Figure 2:
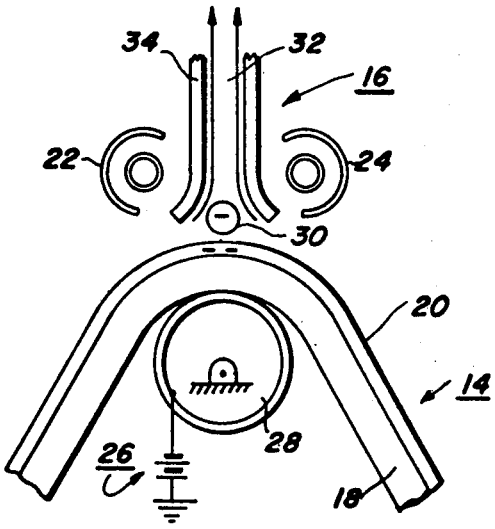
FIG. 2 shows the preferred embodiment of the present invention.

Referring to FIGS. 1 and 2, the present invention will now be described. FIG. 1 shows the conventional pre-clean state of a photoreceptor 10 in which a positive latent image is developed by negatively charged toner 12. Not all of the toner is transferred during the transfer operation, and a small amount of charged residual toner remains on the photoreceptor which must be removed before the photoreceptor is charged once again.

FIG. 2 shows a flexible belt-type photoreceptor 14 moving through a cleaning station 16 incorporating the present invention. The photoreceptor 14 includes a conductive substrate 18 and an ambipolar photoconductive layer 20. A suitable material for the photoconductive layer is described in U.S. Pat. No. 3,954,906, the latter being incorporated by reference herein. As the photoreceptor 14 moves through the cleaning station 16, the photoconductive layer is simultaneously exposed to light sources 22 and 24, and charged to the same polarity as that of the toner by a voltage source 26 through a conductive rubber roll 28. At the same time, the photoreceptor is vibrated because the roll 28 is mounted to rotate off-center, and the toner 30 is drawn away from the photoreceptor by a vacuum 32 drawn through a transparent conduit 34. Thus, with the present invention, residual toner is simultaneously subject to several forces without any contact by an abrasive cleaning element. The toner is subjected to the repelling force of the charged photoconductive layer 20, a vibrating force produced by the roll 28, and the vacuum 32.

Figure 3:
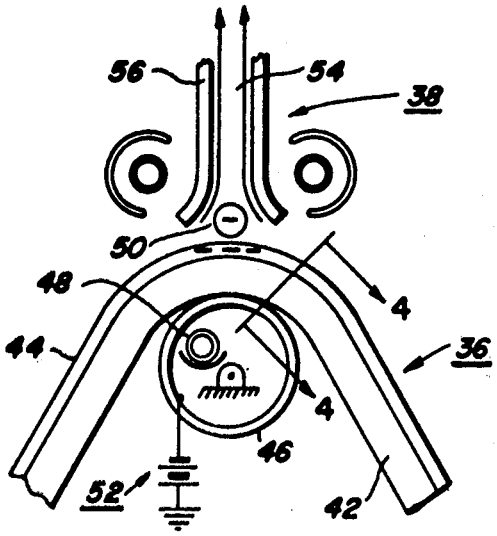
FIGS. 3 and 4 show an alternative embodiment in which the photoconductive layer of the photoreceptor is exposed through a transparent substrate.
Figure 4:
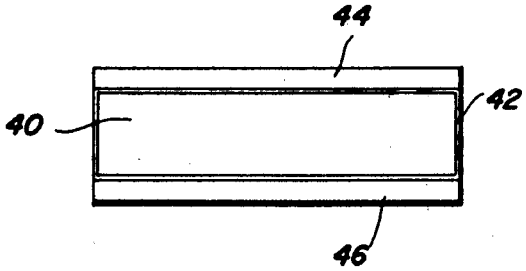

With the present invention, the photoconductive layer could also be exposed from the opposite side thereof if desired. FIGS. 3 and 4 show an alternative arrangement for effecting this. A flexible belt-type photoreceptor 36 is moving through a cleaning station 38 incorporating the present invention. The photoreceptor 36 is comprised of a transparent substrate 40 made from a suitable material such as MYLAR, a thin (approx. 0.25 to 2.0 microns) light-transmitting conductive metallic coating 42, and an ambipolar photoconductive layer 44 as described above. A transparent conductive roll 46 (made of a suitable material such as NESA glass) along with at least one other roll is used to support and move the photoreceptor around a closed path, the roll 46 being mounted to rotate off-center so as to vibrate the photoreceptor as the latter moves through the cleaning station. As the photoreceptor 36 moves through the cleaning station 38, the photoconductive layer 44 is simultaneously exposed to a light source 48 and charged to the same polarity as that of the toner 50 by a voltage source 52. The toner 50 is drawn away from the photoreceptor by a vacuum 54 drawn through a conduit 56. Thus, as can be seen, this alternative embodiment functions in the same manner as the embodiment described above except that the photoconductive layer 44 is exposed through the transparent substrate 40.

While the invention has been described with reference to the structure disclosed, it is not confined to the details set forth, but is intended to cover such modifications or changes as may come within the scope of the following claims. For example, while the preferred embodiments described above use vacuum to remove the toner, gravity could also be used if machine configuration permitted. Also, any other suitable means (e.g., a transducer) might be used to vibrate the photoreceptor.

What is claimed is:

1. In a cleaning method for removing electrostatically charged residual toner from a photoreceptor having a substrate and a photoconductive layer, the improvement comprising the steps of:

(a) electrostatically charging the photoconductive layer to the same polarity as that of the toner, (b) rotating a roller about an eccentric axis with the photoreceptor entrained about the roller to induce vibrations in the photoreceptor, (c) exposing the photoconductive layer to light, and (d) removing the toner from the photoreceptor.

2. The method set forth in claim 1, wherein said step of exposing occurs during the charging step.

3. The method set forth in claim 1, wherein the substrate is transparent, and said step of exposing includes transmitting light through the transparent substrate towards the photoconductive layer.

4. The method set forth in claim 1, wherein all of the steps occur simultaneously.

5. The method set forth in claim 3, wherein all of the steps occur simultaneously.

* * * * *